US011879253B2

(12) United States Patent
King et al.

(10) Patent No.: US 11,879,253 B2
(45) Date of Patent: Jan. 23, 2024

(54) SYSTEM AND METHOD FOR ADHERING ROOF INSULATION PRODUCTS TO A ROOFING SUBSTRATE

(71) Applicants: Gregory James King, Rochester, MN (US); Susan Marie King, Rochester, MN (US); Chad Gregory King, Rochester, MN (US)

(72) Inventors: Gregory James King, Rochester, MN (US); Susan Marie King, Rochester, MN (US); Chad Gregory King, Rochester, MN (US)

( * ) Notice: Subject to any disclaimer, the term of this patent is extended or adjusted under 35 U.S.C. 154(b) by 63 days.

(21) Appl. No.: 17/452,666

(22) Filed: Oct. 28, 2021

(65) Prior Publication Data

US 2023/0035559 A1 Feb. 2, 2023

Related U.S. Application Data

(60) Provisional application No. 63/203,569, filed on Jul. 27, 2021.

(51) Int. Cl.
*E04D 3/36* (2006.01)
*E04D 3/35* (2006.01)
*E04D 11/02* (2006.01)

(52) U.S. Cl.
CPC ..... *E04D 3/3603* (2013.01); *E04D 3/352* (2013.01); *E04D 11/02* (2013.01)

(58) Field of Classification Search
CPC ..... E04D 3/352; E04D 3/354; E04D 3/355; E04D 3/357; E04D 3/3603; E04D 3/3606; E04D 11/02; E04D 3/3601; E04D 3/3602; E04D 3/3608; E04D 3/38
USPC ..... 52/742.1, 742.13, 742.14
See application file for complete search history.

(56) References Cited

U.S. PATENT DOCUMENTS 3,135,069 A * 6/1964 Schuller ..... E04D 11/02 52/526
3,138,899 A * 6/1964 Hadley ..... E04C 3/293 52/410
4,084,362 A * 4/1978 Piazza ..... E04B 1/4121 52/705
4,227,356 A 10/1980 Stern et al.
4,783,942 A 11/1988 Nunley et al.
5,406,765 A * 4/1995 Brown ..... E04D 11/02 52/409
6,314,700 B2 11/2001 Starr
(Continued)

*Primary Examiner* — William V Gilbert
(74) *Attorney, Agent, or Firm* — Dunlap Bennett & Ludwig, PLLC

(57) ABSTRACT

A method and system for adhering roofing products to a supporting roof substrate, wherein ballast rock from a pre-existing roof insulation system is removed thereby exposing one or more layers of pre-existing insulation products supported by the roof substrate. In the case of new construction, the method contemplates installation of one or more layers of insulation products supported by the roof substrate. Core holes are formed through the one or more layers of insulation products thereby exposing the roof substrate. An anchor is attached to the roof substrate in each core hole void, and a binding agent is applied to each core hole void until the binding agent fills the core hole void, whereby the one or more layers of insulation products and roof substrate are locked together, preventing shifting of the insulation products without the need for adding ballast rocks thereon.

13 Claims, 3 Drawing Sheets

(56) References Cited

U.S. PATENT DOCUMENTS

| | | | | |
|---|---|---|---|---|
| 7,805,900 | B2 | 10/2010 | Kelly | |
| 7,987,647 | B2 | 8/2011 | Rymell et al. | |
| 8,567,144 | B2 | 10/2013 | Kelly | |
| 8,635,825 | B2 | 1/2014 | Bacon et al. | |
| 8,701,366 | B2 | 4/2014 | Oberg | |
| 10,100,524 | B2 | 10/2018 | Freeman | |
| 10,866,012 | B2 | 12/2020 | Kvasnicka et al. | |
| 10,934,716 | B2 | 3/2021 | Billings et al. | |
| 10,968,633 | B2 | 4/2021 | Kelly | |
| 11,008,757 | B1 | 5/2021 | Decker et al. | |
| 2006/0096212 | A1 | 5/2006 | Panasik | |
| 2006/0099370 | A1* | 5/2006 | Glass | B32B 27/06 428/40.1 |
| 2006/0236627 | A1* | 10/2006 | Messenger | E04B 1/0007 52/272 |
| 2006/0240243 | A1 | 10/2006 | Leslie | |
| 2006/0254015 | A1* | 11/2006 | Sullivan | E04D 5/148 15/236.04 |
| 2007/0175170 | A1 | 8/2007 | Shah | |
| 2008/0110119 | A1* | 5/2008 | Gembala | E04D 11/02 52/432 |
| 2013/0061553 | A1* | 3/2013 | Nagy | E04B 1/04 52/742.16 |

* cited by examiner

SYSTEM AND METHOD FOR ADHERING ROOF INSULATION PRODUCTS TO A ROOFING SUBSTRATE

CROSS-REFERENCE TO RELATED APPLICATION

This application claims the benefit of priority of U.S. provisional application No. 63/203,569, filed 27 Jul. 2021, the contents of which are herein incorporated by reference.

BACKGROUND OF THE INVENTION

The present invention relates to roofing construction and repair and, more particularly, a system and method for adhering roofing insulation products to roof systems. The disclosure provides for new construction of roofing systems as well as renovation and/or repair of previously rock-ballasted rubber roof systems, whereby the present invention gains adhesive properties and prevents shifting of the roofing insulation products without the need for ballast rocks.

Previously, during roof construction of or repair to commercial roofs, ballast rocks were laid down over the top of the newly installed roofing insulation product(s) to prevent their shifting under wind loads. Typically, the rock ballast roof systems have multiple layers of sheet foam to obtain a satisfactory thermal insulation value for the roof system. Frequently, the exterior of these insulation products is layered with a water membrane (such as a rubber membrane) that is then covered with a layer of ballast rock to prevent the shifting or loss of the insulation products. Sub-optimally, the layer of ballast rocks adds ten to twenty-five pounds per square foot to the roof system and increases the labor and cost in the installation of the roofing project.

Furthermore, when installing roof insulation products (e.g., a spray foam roof overlay system, foam sheets, approved waterproof membrane, etc.) to an aging flat or low slope roof it is of course necessary to remove the roof's ballast rocks that are holding down the pre-existing insulation products. Removal of pre-existing ballast rocks takes time and adds to the expense of the project; therefore, if the installer can avoid replacing the ballast rocks, then present and future cost savings can be realized.

Moreover, current roof insulation installation techniques frequently utilize a pin-and-plate method to anchor the roof insulation. The thermal conductivity of the metallic fasteners involved in the pin-and-plate method, however, frustratingly effectuate "thermal bridging". Thermal bridging happens when the thermal conductive elements of the pin-and-plate method thermally connect the external environment to the internal roof decking system, allowing heat to escape from the interior space of the building by way of the 'thermal bridge'.

Finally, removal of the ballast rock to an existing roofing system or non-inclusion of the rock ballast for new a ballasted rubber roof allows the rubber and layers of insulation productions (e.g., sheet foam board) to move under the uplift force of the wind, thereby resulting in loss of thermal conductivity and possibly causing structural damage by the way of the moving insulation products.

As can be seen, there is a need for a system and method for securing existing or new insulation products to roof systems without the need for ballast rock. The system and method embodied in the present invention includes creating spaced apart core holes in the insulation products supported by the roof deck, anchoring fasteners to the roof deck in the space defined by each core hole, and applying adhesive or binding products into the core holes, wherein the adhesive/binding agent forms a locked engagement between the roof deck and the roof insulation products and any covering thereof, thereby preventing the shifting of the roof insulation products under heavy wind loads without the need for ballast rocks.

The method contemplates new construction as well as repair/renovation to pre-existing roofs that were using ballast rock, wherein the existing insulation products are to be secured to the roof deck or roof substrate. The repair methodology includes removing the ballast rocks and creating the core holes in the existing insulation and membranes on the roof substrate and applying adhesive/binding agent into the core holes, which binds the substrate and layers of existing and/or new roof insulation products together.

The core holes may be openings or perforations formed by a drill or other suitable equipment. The nature of these core holes/openings/perforations allows adhesion to the present insulation layers/members and the roof substrate/deck that supports these products/layers. The adhesive and/or binding agent may be closed cell roof foam or the like. In some embodiments of the present disclosure the aged rubber member is removed, and a new top cover board is added to accept a monolithic coat of spray foam insulation or any approved water proofing system over the upper most portion of the roof.

SUMMARY OF THE INVENTION

In one aspect of the present invention, a method of adhering one or more roof products to a substrate, the method including the following: forming at least one core hole through each of the one or more roof products so that the substrate is exposed; attaching, in each core hole, an anchor to the substrate; and applying a binding agent to each core hole so that the binding agent engages the substrate, the anchor, and each of the one or more roof products.

In another aspect of the present invention, the method includes wherein the one or more roof products are two or more sheets oriented in a stacked arrangement, wherein the substrate is a roof deck, and wherein the anchor is a plate have a surface area between one-quarter and three quarters of a cross-section of the core hole.

In yet another aspect of the present invention, a method of improving a roof system using a layer of ballast rocks over a plurality of stacked insulation sheets supported by a roof substrate, the method includes the following: removing the layer of ballast rocks; forming at least one core hole through each of the plurality of stacked insulation sheets so that the roof substrate is exposed; attaching, in each core hole, an anchor to the roof substrate; and applying a binding agent to each core hole so that the binding agent engages the roof substrate, the anchor, and the plurality of stacked insulation sheets; laying a cover board over the plurality of stacked insulation sheets prior to forming the at least one core hole, wherein the binding agent also engages the cover board; trimming a portion of the binding agent that protrudes from each core hole; overlaying a layer of foam insulation over the cover board, wherein a cross-section of each core hole has a diameter of approximately four inches, and wherein there are four or more core holes for each thirty-two square feet of the plurality of stacked insulation sheets.

In still yet another aspect of the present invention, a roof insulation system includes a roof deck; a plurality of stacked insulation products; at least one core hole in the plurality of stacked insulation products; in each core hole, an anchor attached to the roof deck; and a binding agent substantially filling the core hole, wherein the anchor has a plurality of anchor apertures.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a method and system for adhering roofing products to a supporting roof substrate. The method and system both contemplate any ballast rock being removed from pre-existing roof insulation systems, thereby exposing one or more layers of pre-existing insulation products supported by the roof substrate such as a roof deck. In the case of new construction, the method contemplates installation of one or more layers of insulation products supported by the roof substrate. Core holes are formed through the one or more layers of insulation products thereby exposing the roof substrate. An anchor is attached to the roof substrate in each core hole void, and a binding agent is applied to each core hole void until the binding agent fills the core hole void, whereby the one or more layers of insulation products and roof substrate are locked together, preventing shifting of the insulation products without the need for adding ballast rocks thereon.

Referring now to FIGS. 1 through 5, the present invention may include a system and method for securing roofing layers to a roof substrate, including but not limited to securing insulation products to rubber ballast roof systems without the need for ballast rock.

Figure 5:
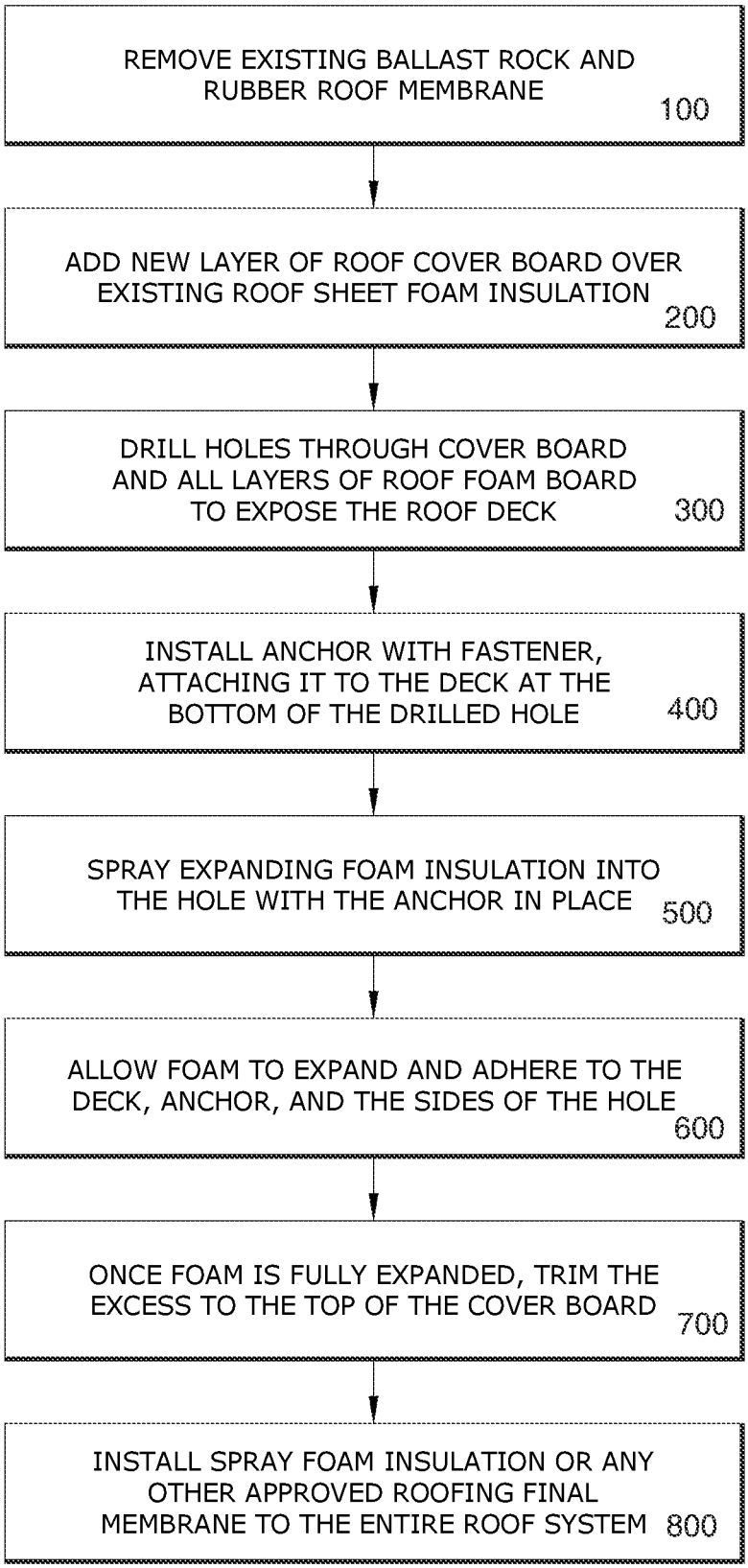
FIG. 5 is a flow chart of an exemplary embodiment of the present invention.

Referring the FIG. 5, a method of repairing or renovating the external roof insulation is disclosed. Step 100 may include removing the ballast rock and in certain embodiments the roof membrane immediately under the ballast rock, thereby exposing the pre-existing roof insulation 12 and/or 14. Step 200 may include adding a cover board 10 over the exposed pre-existing roof insulation 12 and/or 14 (the cover board 10 may be added in contemplation of adding a new top insulation product thereon). In step 300, the method involves creating core holes 16 through the cover board 10 and the pre-existing roof insulation 12 and/or 14 so that the roof deck 18 is visible through the core hole 16. In step 400, an anchor 20 is attached, by way of a fastener 22, to the exposed roof substrate 18 at the bottom of the core hole 16. Step 500 includes filling the void, after attaching the anchor 20, defined by the core hole 16 with a binding agent 24, such as but not limited to expanding foam insulation that can be sprayed into the core hole 16. The installer, in step 600, allows the binding agent 24 to expand and adhere to the roof substrate/deck 18, the intermediate pre-existing roof insulation layers 12 and/or 14 and, if applicable, the cover board 10. In step 700, once the congealed binding agent is fully expanded, the installer can trim any excess binding agent protruding from the core hole 16 (beyond the cover board 10, when applicable). In step 800, an additional layer of roof insulation product(s), like spray foam insulation or other approved roofing final membrane, may be added to the entire roof system over the cover board 10.

Figure 1:
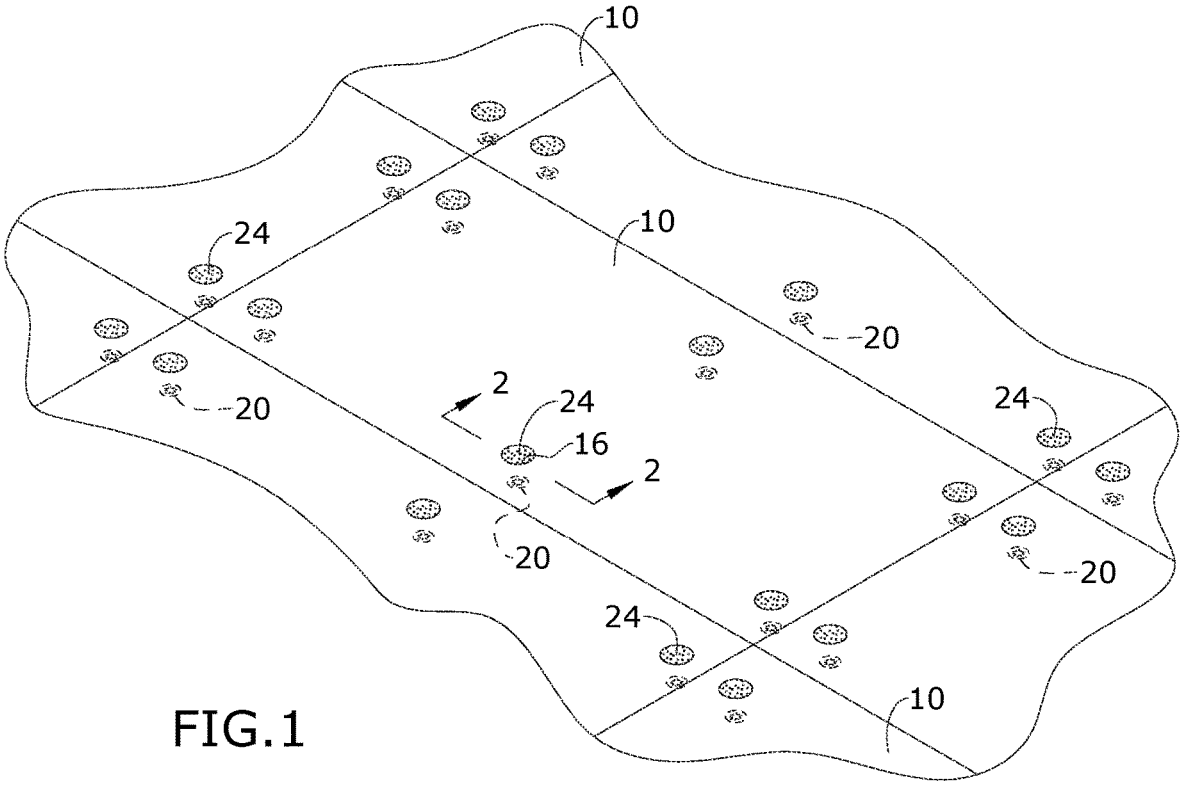
FIG. 1 is a perspective view of an exemplary embodiment of the present invention.
Figure 2:
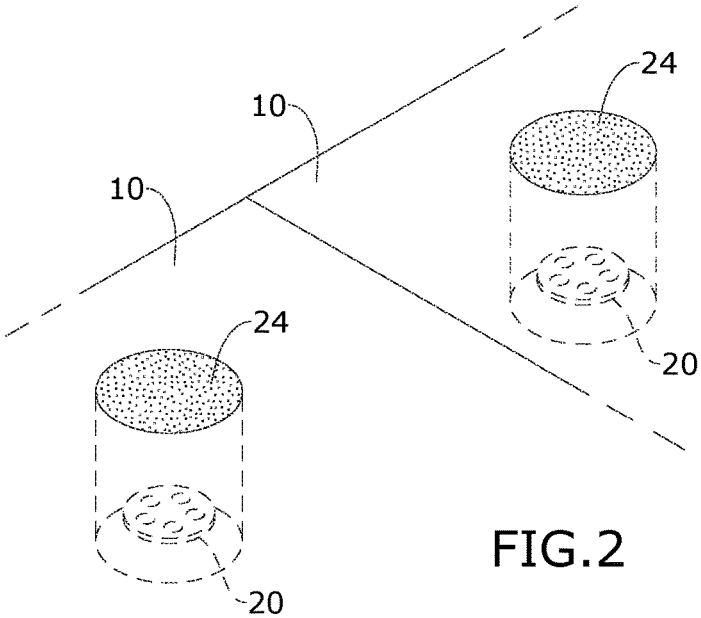
FIG. 2 is a section view of an exemplary embodiment of the present invention, taken along line 2-2 in FIG. 1.
Figure 3:
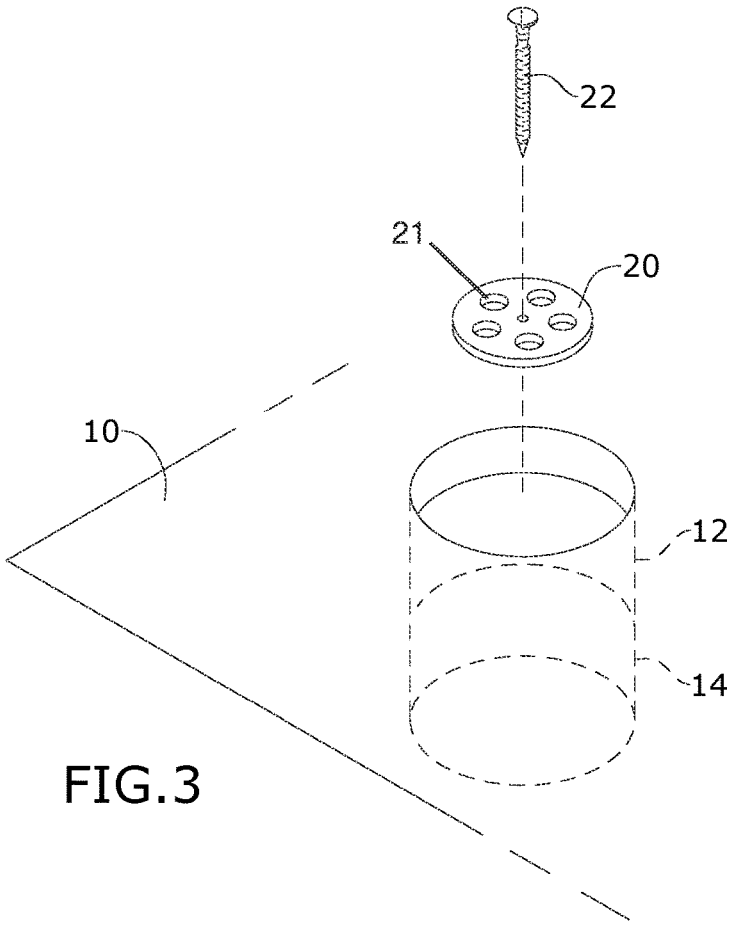
FIG. 3 is an exploded perspective view of an exemplary embodiment of the present invention.
Figure 4:
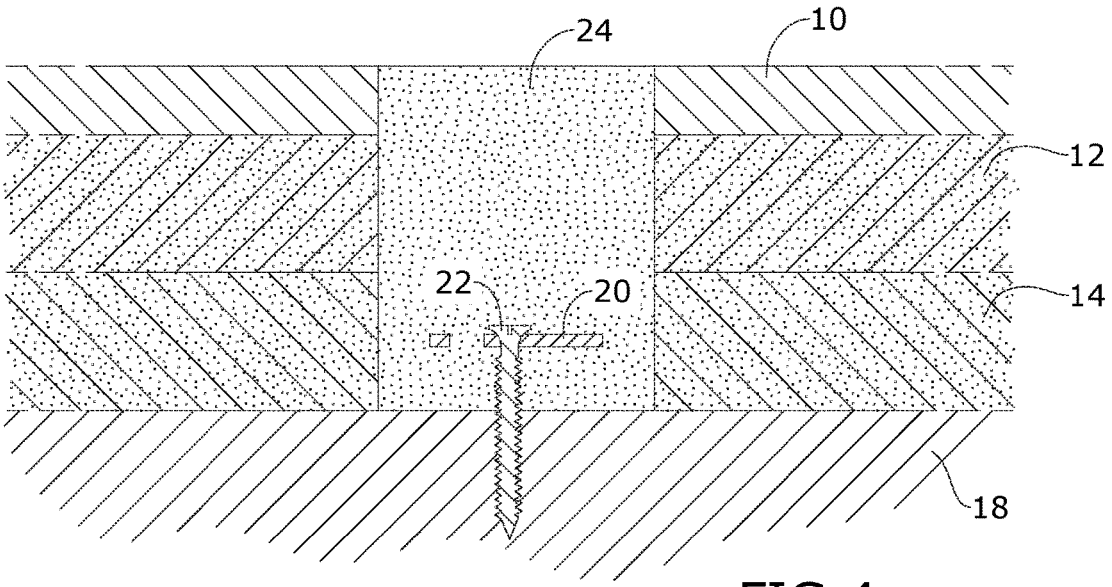
FIG. 4 is a detailed perspective view of an exemplary embodiment of the present invention.

In certain embodiments, the cutting of the core holes 16 may include penetrating the rubber roof membrane that is present (in situations where it was not removed along with the ballast rock in the repair/renovation solution). The core hole 16 may be approximately four inches in diameter but can range from two to eight inches in diameter or more. There may be approximately six core holes 16 for every four-foot by eight-foot sheet of roof board, as illustrated in FIG. 1. The binding agent 24 may be spray foam (including, but not limited to, polyurethane). Installation of the appropriate number and placement of core holes/openings/perforations 16 through the roof materials to adhere the spray foam roofing system to the original decking system may include using any size opening dimensioned sufficiently to allow spray foam 24 to create an anchor or footing to attach the roofing insulation system to the roof substrate 18. The spraying of the foam 24 may form seamless layers of closed cell foam to the entire roof area.

The fastener 22 may be connected to the roof substrate/deck 18 at about the center of the core hole 16. The anchor 20 may be a plate having a diameter greater or less than half the diameter of the core hole 16. The locking fastener/anchor 20 can be made of many different materials. Its purpose is to give the bind agent 24 or adhesive material an structure fixed to the roof substrate/deck 18 to embed in a cementitious manner, as it fills and binds all layers of roofing materials together. The anchor 20 may have a plurality of apertures 21 to facilitate the binding agent 24 engaging the anchor 20. Specifically, the binding agent 24 will ooze through the anchor apertures 21 during initial application of the binding agent 24.

The roof substrate 18 includes many kinds of roof substrates and decks adapted to support the roof insulation products thereon.

In short, the method of the present disclosure does not remove insulation under the membrane in the repair/renovation solution, as opposed to the prior art.

The system embodied by the present invention can be used on existing spray foam roofs to stop shifting or moving of roof deck system through installing the core holes 16 to allow adhesion of the surface rubber roof to the underling roof substrate/deck 24. The core holes/openings/perforations may be applied to an existing system prior to applying spray foam insulation over the top of the rubber covering, allowing the rubber to be adhered and/or glued to the roof substrate or deck. The process of adhering the existing roof materials to the roof substrate will save millions of square foot of existing roofing materials from being discarded in the landfills.

The adhesion method embodied in the present invention eliminates the need for existing ballast rock, making future repairs and application of insulation products simpler and less expensive. It also eliminates a great deal of weight on the roof of the structure. Also, the present invention eliminates the thermal bridging possible with the use of metal pins and plates on the exterior surface of the rubber membrane which lies just under the ballast rock. The core filling system of the present invention locks all components together and to the roof deck, greatly reducing or eliminates shifting and lifting of the roof insulation products.

It should be understood that the steps disclosed herein may be used in new construction or in renovations that do not have pre-existing ballast rock. And so the present invention also contemplates installing a roof deck (or removing the covering of a pre-existing roof deck 18 all the way down to the original roof decking) and then adding the two layers of foam board 12 and 14 on the roof deck 18. Then the user would add the cover board 10 (which includes many types of roof layers, such as recovery board or roof board). From there, the user/installer would proceed to step 300.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A method of adhering a plurality of stacked roof products to a substrate, the method comprising:

forming at least one core hole through the plurality of stacked roof products so that the substrate is exposed;

attaching, in each said core hole, an anchor to the substrate, wherein the anchor comprises an anchor plate having a plurality of anchor apertures, and wherein the anchor plate is spaced apart from the substrate upon attachment; and applying a binding agent to each said core hole so that the binding agent encases the anchor plate.

2. The method of claim 1, wherein the substrate is a roof deck.

3. The method of claim 1, wherein the plate has surface area between one-quarter and three quarters of a cross-section of a respective one of the core holes.

4. The method of claim 1, wherein after application, the binding agent engages the plurality of roof products in a locked engagement comprising the binding agent below the anchor plate and through the plurality of anchor apertures.

5. The method of claim 4, wherein the binding agent engages the substrate in the locked engagement.

6. A method of improving a roof system using a layer of ballast rocks over a plurality of stacked insulation sheets supported by a roof substrate, the method comprising:

removing the layer of ballast rocks;

forming at least one core hole through each of the plurality of stacked insulation sheets so that the roof substrate is exposed;

attaching, in each said core hole, an anchor plate to the roof substrate; and applying a binding agent to each said core hole so that the anchor plate is encased on all sides thereof in the binding agent.

7. The method of claim 6, further comprising laying a cover board over the plurality of stacked insulation sheets prior to forming the at least one core hole, wherein each said core hole is formed through the cover board, wherein the binding agent also engages the cover board.

8. The method of claim 7, further comprising trimming a portion of the binding agent that protrudes from each said core hole until an upper surface of the binding agent is substantially flush with an upper elevation of the plurality of stacked insulation sheets.

9. The method of claim 8, further comprising overlaying a layer of foam insulation over the cover board.

10. The method of claim 9, wherein a cross-section of each said core hole has a diameter of approximately four inches, and wherein there are four or more said core holes for each thirty-two square feet of the plurality of stacked insulation sheets.

11. A roof insulation system, comprising:

a roof deck;

a plurality of stacked insulation products;

at least one core hole in the plurality of stacked insulation products;

in each said core hole, an anchor plate attached to the roof deck; and a binding agent substantially filling each said core hole so that the anchor plate is encased on all sides thereof.

12. The roof insulation system of claim 11, wherein after attachment of the anchor plate in each said core hole, the anchor plate is spaced apart from the roof deck.

13. The roof insulation system of claim 12, wherein each said anchor plate comprises a plate with a plurality of apertures, wherein after application of the binding agent, the binding agent fills one or more of the plurality of apertures.

* * * * *